United States Patent [19]

van der Lely

[11] 4,065,905

[45] Jan. 3, 1978

[54] PREFABRICATED BUILDING SECTIONS OR ROOM UNITS AND METHODS FOR THE MANUFACTURE OF SUCH SECTIONS OR UNITS

[76] Inventor: Cornelis van der Lely, 7, Bruschenrain, Zug, Switzerland

[21] Appl. No.: 617,507

[22] Filed: Sept. 29, 1975

Related U.S. Application Data

[63] Continuation of Ser. No. 389,739, Aug. 20, 1973, abandoned.

[30] Foreign Application Priority Data

Aug. 21, 1972 Switzerland ..... 389739/72

[51] Int. Cl.[2] ..... E04H 1/04

[52] U.S. Cl. ..... 52/741; 52/79.1

[58] Field of Search ..... 52/79, 745; 29/155

[56] References Cited

U.S. PATENT DOCUMENTS 3,568,380 3/1971 Stucky ..... 52/79

FOREIGN PATENT DOCUMENTS 1,037,990 5/1953 France ..... 52/234

*Primary Examiner*—John E. Murtagh

*Attorney, Agent, or Firm*—Mason, Mason & Albright

[57] ABSTRACT

A rectangular panel manufactured for inclusion in prefabricated building sections having a steel frame of beams in with top and bottom horizontal flanges extending inwardly and flush of the top with a concrete floor slab and on the bottom with a ceiling member, the space between same receiving electrical conduits and the like mounted on the floor slap or ceiling member or both. The longer beams are connected by ribs having approximately a Z-shaped cross-section. At each corner of the panel an opening is provided for a vertical steel tube, each opening being defined in part by recesses in the adjacent flanges to which the tube is welded. A jig plate is provided within the panel to surround the tube together with the corner structure and a castable fireproof material is introduced between the tube and jig plate on the outer sides and between the tube and the beams proximate the corner, apertures being provided in the flanges for this purpose if necessary.

35 Claims, 8 Drawing Figures

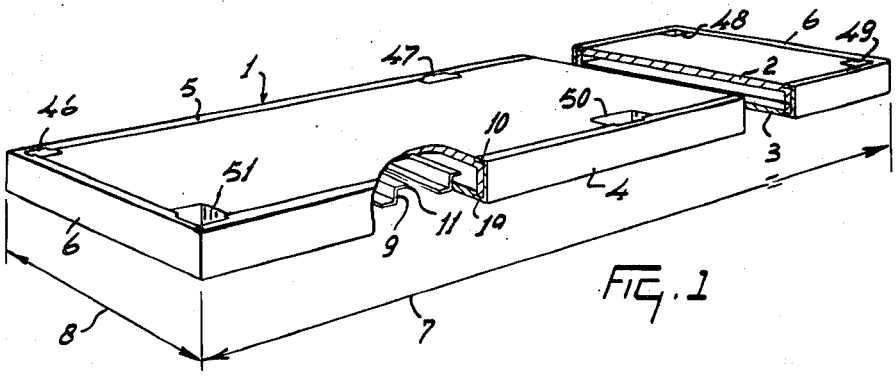
FIG. 1
FIG. 2
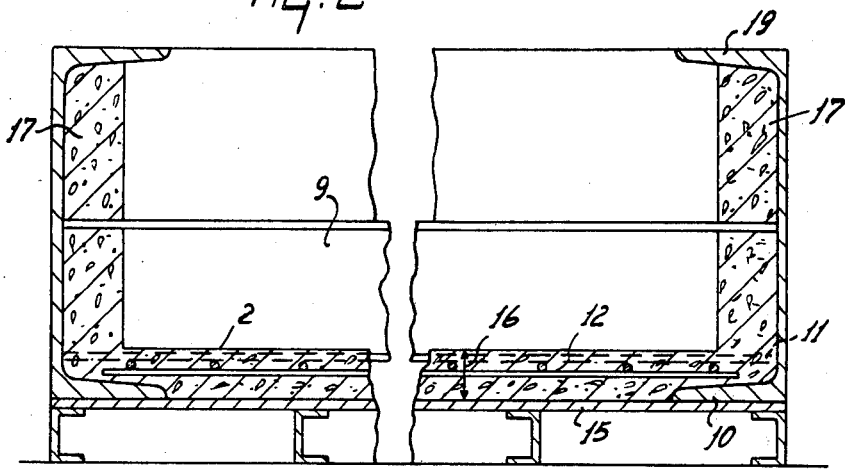
FIG. 3
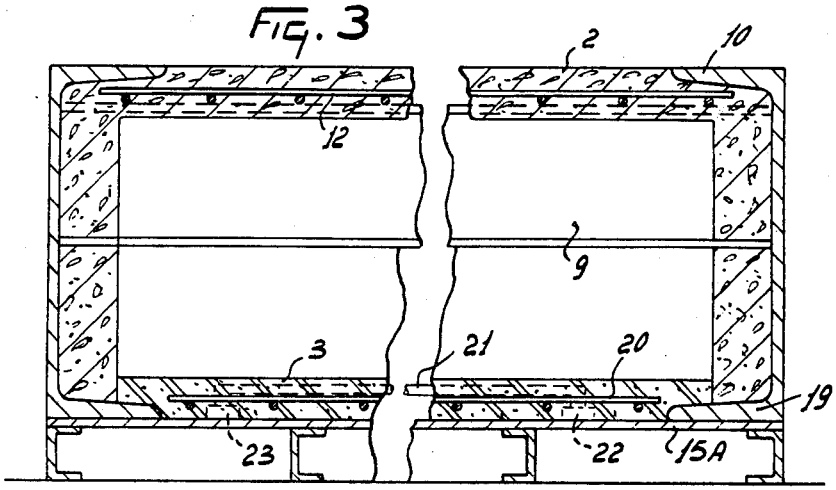

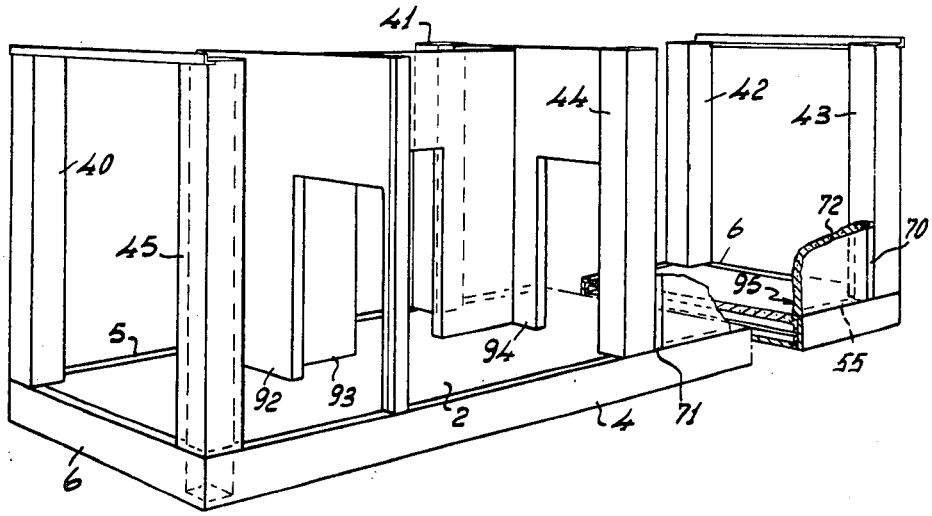
FIG. 5
FIG. 4
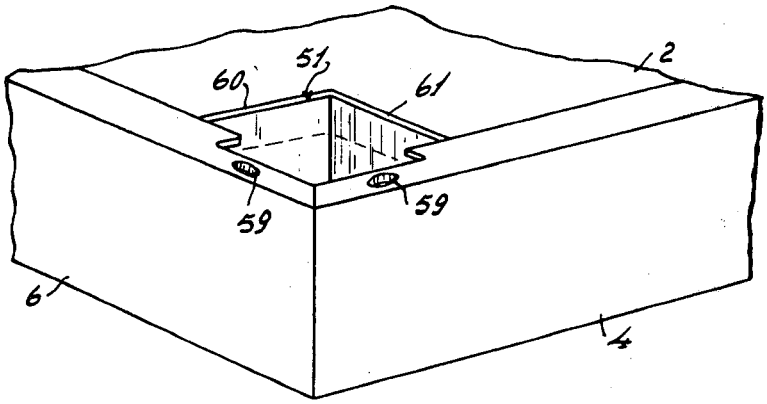

PREFABRICATED BUILDING SECTIONS OR ROOM UNITS AND METHODS FOR THE MANUFACTURE OF SUCH SECTIONS OR UNITS

This is a continuation application of applications Ser. No. 389,739 filed Aug. 20, 1973 now abandoned.

SUMMARY OF THE INVENTION

This invention relates to prefabricated building sections or room units and to methods for the manufacture of such sections or units.

According to one aspect of the invention, there is provided a method for the manufacture of prefabricated building sections or room units comprising making a panel and subsequently connecting at least one frame beam and/or at least one wall or other partition to that panel, wherein making the panel comprises the steps of forming a frame of beams, arranging a first plate on said frame, arranging a second plate on said frame and providing the panel with at least one tubular service conduit, the completed panel subsequently having the frame beam and/or wall or other partition connected thereto.

For a better understanding of the invention, and to show how the same may be carried into effect, reference will now be made, by way of example, to the accompanying drawings, in which:

BRIEF DESCRIPTION OF THE DRAWINGS

FIG. 1 is a perspective view of a floor panel constructed in accordance with the invention, FIG. 2 is a sectional view, to an enlarged scale, illustrating the formation of part of the floor panel in a mould, FIG. 3 is a further sectional view, to the same scale as FIG. 2, showing a subsequent stage in the formation of the floor panel in a jig, FIG. 4 is a perspective view, to an enlarged scale, showing additional details of the construction of one corner of the floor panel of FIG. 1, FIG. 5 is a perspective view to the same scale as FIG. 1 showing the floor panel of that Figure provided with walls and frame beams, the latter being in the form of supporting columns.

DESCRIPTION OF THE PREFERRED EMBODIMENT

Figure 6:
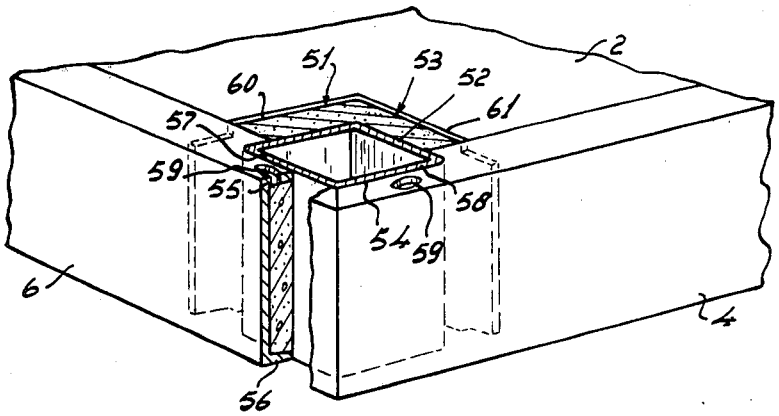
FIG. 6 is a perspective view, partly in section and to the same scale as FIG. 4, showing the form of cooperation between the panel and the lower end of one of the supporting columns of FIG. 5.

Referring now to FIGS. 1 to 3 of the drawings, the floor panel that is illustrated has a frame which is generally indicated by the reference 1 and which is formed from a plurality of metal beams. Two plates 2 and 3 are arranged inside the frame 1 in parallel but spaced apart relationship, said plates 2 and 3 preferably being made from concrete which is cast in the frame 1. The frame 1 which is illustrated is of oblong configuration having two longer side beams 4 and 5 that are parallel to one another and two shorter end beams 6 which are also parallel to one another and perpendicular to the beams 4 and 5. The beams 4, 5 and 6 are all of channel-shaped cross-section and their ends are welded to each other at the four corners of the frame 1. The frame 1 that is illustrated has a length 7 of substantially 12 meters and a width 8 of substantially 3 meters, the length 7 of the frame thus being substantially four times the width 8 thereof.

In order to cast the concrete plates 2 and 3 inside the frame 1 and to obtain a satisfactory bond between the metal beams and the concrete of said plates, the longer beams 4 and 5 are perpendicularly interconnected by a large number of ribs 9 that are of approximately Z-shaped cross-section. The cross-section is, in fact, such that each rib 9 has upper and lower horizontal limbs 11 that are perpendicularly interconnected by a vertical limb in such a way that the upper and lower horizontal limbs are substantially out of vertical alignment with one another. The arrangement of the ribs 9 is also such that, as seen in FIG. 1 of the drawings, a substantially horizontal plane containing the upper limbs 11 thereof is located at a level beneath that of a substantially horizontal plane containing the upper limbs 10 of the channel-shaped (in cross-section) frame beams 4 and 5. Metallic mesh 12 which serves as a reinforcement is arranged above the upper limbs 11 of the ribs 9 (see FIG. 3 of the drawings) and is welded to the beams of the frame 1 after the construction of that frame. If desired, further reinforcing mesh may be provided in contact with the upper limbs 11 of the ribs 9. After the frame 1 has been assembled and has been provided with the ribs 9 and the metallic mesh 12, the whole assembly is inverted and is placed on a jig table 15 as shown in FIG. 2 of the drawings. Concrete is then poured to form the plate 2 to a vertical thickness 16 which may, for example, have a magnitude of substantially five centimeters. An upright concrete rim 17 that is disposed internally of the frame beams 4, 5 and 6 is poured at the same time as the plate 2.

When the plate 2 and rim 17 have set, the partially completed panel is lifted from the jig table 15, subsequently inverted to bring it to its original disposition and is then lowered onto a jig table 15A as shown in FIG. 3 of the drawings. However, before putting the panel on the jig table 15A, a metallic reinforcing mesh 20 is welded between the lower limbs 19 of the frame beams 4, 5 and 6. When required, as will usually be the case, tubular conduits 21 for electric cables together with junction and connection boxes 22 and 23 are placed in position with the metallic reinforcing mesh 20 and may, if desired, be secured to that mesh. The concrete or other castable material of the plate 3 is subsequently poured or otherwise introduced onto the jig table 15A around the parts 20 to 23 inclusive as shown in FIG. 3 of the drawings. Holes may be formed through the plate 2 to enable the semi-liquid concrete or other castable material to be brought to the position in which it is to set to form the plate 3. However, as an alternative, the concrete or other castable material that is to form the plate 3 may be arranged on the jig table 15A before the partially completed panel is itself lowered onto that jig table. When this method of formation is employed, it is possible to lower the partially completed panel onto the jig table 15A in such a way that the lower limbs 19 of the beams of its frame 1 penetrate into the waiting semiliquid concrete or other castable material to a sufficient extent to bring those limbs firmly into contact with the upper surface of the jig table 15A. Once the concrete or other castable material of the plate 3 has set or otherwise hardened, the substantially completed frame 1 can be lifted away from the jig table 15A ready for use as part of a prefabricated building that is to be erected or for use as part of a prefabricated building section or room unit that is itself destined for employment as one part of a prefabricated building.

The panel whose construction has been described with particular reference to FIGS. 1 to 3 of the drawings is intended for use as a floor panel but it is emphasized that panels intended for use as walls and other partitions are made in a similar way. In the case of the floor panel whose construction has been described, the plate 2 is intended to serve as an upper load-bearing surface for human beings, furniture and so on whereas the lower plate 3 is intended to serve as a ceiling for the room or other space that may be formed beneath the floor penel in question. If the floor panel should be part of a story located at ground level, then the plate 3 will co-operate with an underlying foundation. FIG. 5 of the drawings illustrates the floor panel that has been described forming the bottom of a prefabricated three-dimensional building section or room unit. This section or unit is assembled by securing a number of frame beams in the form of supporting columns 40, 41, 42, 43, 44 and 45 inclusive to the panel. In the example which is being described, there are six of the columns 40 to 45 but this is not, of course, essential and other numbers of columns may be used where appropriate. Openings 46, 47, 48, 49, 50 and 51 inclusive (FIG. 1) are formed in the floor panel for the reception of the lower ends of the columns 40 to 45 inclusive and these openings are defined partly by the upper plate 2 and partly by the upper limbs 10 of the beams 4, 5 and 6 of the frame 1.

The connection of each supporting column 40 to 45 to the corresponding one of the openings 46 to 51 is similar and, accordingly, it is only necessary to describe the cooperation of the supporting column 45 with the opening 51 in detail. As can be seen in FIG. 6 of the drawings, the column 45 has a metallic core which, in the example that is being described, is in the form of a tube 52 of substantially square cross-section. This cross-sectional configuration is by no means essential and the core of the column 45 may have other cross-sectional shapes such as, for example, a U-shape or a J-shape. The illustrated tube 52 is surrounded by a layer of fire-proof material 53 such as concrete. The lower end of the tube 52 fits in a matchingly shaped portion 54 of the opening 51 which portion 54 is defined between the frame beams 4 and 6 at one corner of the frame 1. The tube 52 is welded to the beams 4 and 6 at the locations of both the upper and the lower limbs of those beams, the plate 3 and the lower limbs of the beams of the frame 1 being formed with similar openings to the openings 46 to 51 inclusive that are located at the top of the floor panel. The upper and lower openings are, of course, in vertical register with one another.

After the tube 52 has been welded to the beams 4 and 6, it is provided with a layer or sheath of the surrounding fire-proof material 53 to match the remainder of the column 45 that projects above the plate 2. In the illustrated embodiment, the material 53 is concrete and this material, or some other castable fire-proof material, can be cast or otherwise formed around the lower end of the tube 52 after that end has been welded to the frame 1. In order to surround the tube 52 with the concrete affording the fire-proof material 53, that concrete must lie between the upper and lower limbs 55 and 56 of the beams 4 and 6 and the sides 57 and 58 of the substantially square cross-section tube 52. Holes 59 through which the semi-liquid concrete or other castable material can be introduced into these regions are accordingly formed in the upper limbs 55 of the beams 4 and 6. The concrete that affords the portion of the layer fire-proof material 53 that surrounds the sides of the tube 52 remote from the two sides 57 and 58 thereof is kept in its appointed position during setting by jig plates 60 and 61 (FIGS. 4 and 6) that extend between the plates 2 and 3 and into the recesses between the limbs 55 and 56 of the beams 4 and 6. These jig plates 60 and 61, which may be integral, may be placed in their appointed positions at any convenient time during the formation of the plates 2 and 3 of the floor panel or even after the tube 52 has been welded to the frame 1 provided that the necessary access apertures are still available. The concrete or other castable material of the layer 53 that is in the region of the jig plates 60 and 61 can also be introduced through the holes 59.

The fire-proof material 53 can be cast easily around that portion of the column 45 that is located above the plate 2 merely by temporarily arranging a removable jig around said tube 52. Layers of fire-proof material can be provided around the cores of the other columns 40 to 44 inclusive in a similar manner. The necessary jigs are removed immediately after the concrete or other castable material has set or otherwise hardened around the cores of the columns. As an alternative, it is possible to provide the tubes 52 or other column cores with the surrounding layers of fire-proof material 53 before the columns are secured to the frame 1. Under these circumstances, the lowermost ends of the tubes affording the cores will normally be left bare and the concrete or other castable material required to form the fire-proof material 53 around the lower ends thereof will be provided after securing the cores to the frame 1. Walls or other partitions can be arranged between the various supporting columns 40 to 45 above the plate 2 of the floor panel in accordance with the particular part of a building that is to be formed by the building section or room unit in question. The required division of the internal space of the building section or room unit by the walls or other partitions can be effected during the prefabrication of the building section or room unit by forming the partitions from vertical beams 70 and 71 (FIG. 5) between which is a wall portion 72 made of a light cast material, such as concrete. Such a partition comprising the beams 70 and 71 and the intervening wall portion 72 can be prefabricated separately and may then be arranged in a simple manner between two of the supporting columns of the building section or room unit. In the case illustrated in FIG. 5 of the drawings, the partition under discussion is arranged between the supporting columns 43 and 44. The lowermost ends of the beams 70 and 71, which will normally be metal beams, can be welded to the upper limb 55 of the frame beam 4 to secure the partition in position.

Figure 7:
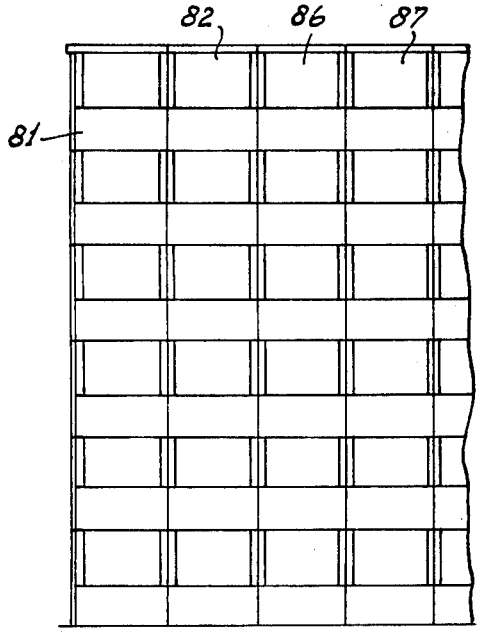
FIG. 7 is a diagrammatic elevation, to a reduced scale, illustrating a block of apartments or other dwellings formed from building sections or room units of the general kind illustrated in FIG. 5.
Figure 8:
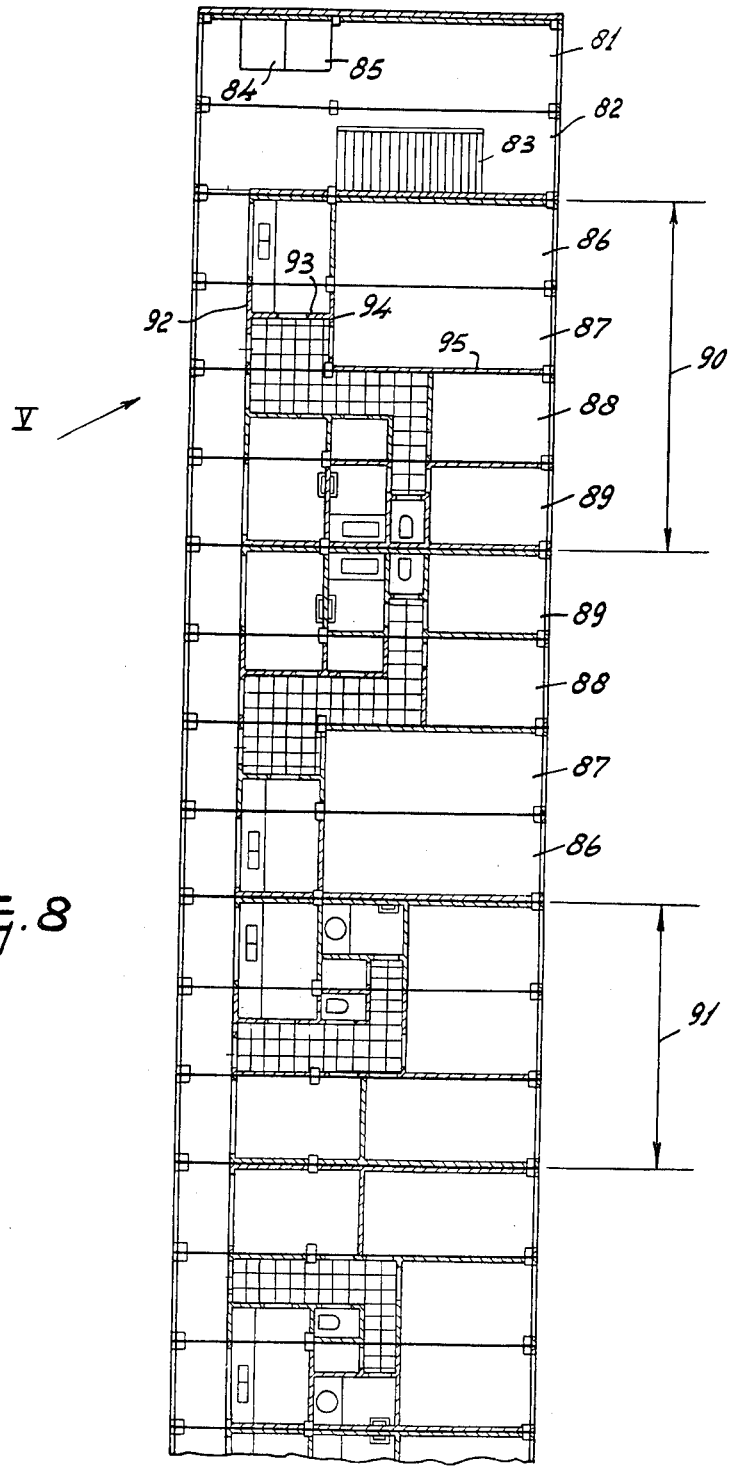
FIG. 8 is a horizontal section through part of one story of the building shown diagrammatically in FIG. 7.

The building section or room unit that is illustrated in FIG. 5 of the drawings may be employed as part of a prefabricated dwelling. FIG. 7 diagrammatically illustrates a multi-story block of apartments formed principally from such building sections or room units and FIG. 8 of the drawings shows the internal arrangements of some apartments or flats in one story thereof. Each story comprises a plurality of adjoining building sections or room units and includes two such sections or units 81 and 82 that are located alongside one another at one end of the building to constitute an entrance hall or vestibule for the story concerned and a staircase 83 for access to other stories. The section or unit 81 also comprises two adjoining lift or elevator shafts 84 and 85. It will be evident that different apartments may require more or less space and apartments or flats of different sizes may be provided in one story, as shown in FIG. 8 of the drawings, by forming them from different numbers of building sections or room units. Four adjoining building sections or room units 86, 87, 88 and 89 constitute a larger apartment 90 having a width of substantially 12 meters whereas three such sections or units constitute a smaller apartment 91 having a lesser width of substantially 9 meters. It will be evident from FIG. 8 that each building section or room unit is provided with appropriate partitions and, during the prefabrication of the sections or units, all of the required main service and other service conduits are incorporated in the floor panels, walls or other partitions. FIGS. 2 and 3 of the drawings show the provision of the tubular conduit 21 and associated junction and connection boxes 22 and 23 but, of course other conduits, such as gas pipes, water pipes for water supply and heating, conduits for television and radio aerial leads and the like can all be incorporated in a similar manner. Kitchen appliances, sanitary equipment and the like are also preferably built into the sections or units during their prefabrication so that a prefabricated building incorporating such sections or units only needs those sections or units to be placed in their correct positions relative to one another during the erection of the building thus substantially limiting the finishing work to the interconnection of the various supply and waste pipes, service conduits and the services carried by those conduits. It will be noted from FIG. 8 of the drawings that, at the junctions of the apartments 90 and 91 with their neighbors, the longer sides of the sections or units that afford those junctions provide double walls thus greatly increasing the noise insulation and security against the spreading of fires.

FIG. 8 of the drawings indicates by an arrow V the direction in which the building section or room unit 87 of FIG. 8 is seen alone in FIG. 5 of the drawings. The section or unit 87 includes four walls or other partitions 92, 93, 94 and 95 the last of which is afforded by the previously mentioned vertical beams 70 and 71 and the intervening wall partition 72. The prefabrication of the floor panels is facilitated by providing each of them with the spaced apart upper and lower plates 2 and 3 so that both the load-supporting floor of an upper story and the ceiling of an underlying story are furnished by a single unit. It is emphasized that, as previously mentioned, a panel similar to that of the kind that has been described with particular reference to FIGS. 1 to 3 of the drawings may be intended fo use as a vertical or at least upright double-skinned wall or other partition. The plates 2 and 3 may, if desired, be formed from some material other than concrete when use as a wall or other partition is intended. The upper plate 2 of the floor panel shown in FIGS. 1 to 3 of the drawings incorporates three tubular conduits 21 for electric cables although only one of those conduits is actually visible in FIG. 3 of the drawings. It is to be noted that different numbers of conduits may be provided particularly in the cases in which the panels are to form walls or other partitions in which the two plates 2 and 3 are formed from the same material. In such a case, both of the plates 2 and 3 may incorporate tubular conduits that are similar to the illustrated conduit 21 and junction and connection boxes 22 and 23 will then be provided in both the plates 2 and 3 so that electricity and other services may be available at both sides of the panel concerned. The conduits 21 that have been mentioned, and further conduits, may be arranged in the space between the two plates 2 and 3. When the described panel is to serve as a floor panel, it is advantageous to form the upper plate 2 from heavy or coarse concrete and the lower plate 3 from light or fine concrete. When the panels are to form vertical or at least upright walls or other partitions in generally box-shaped building sections or room units, some of the beams 4,5 and 6 will be vertically and some horizontally disposed and may be connected to horizontal beams of the skeleton of the section or unit concerned to facilitate the panels being retained in their appointed vertical positions and to facilitate further panels being retained in appointed horizontal positions as floors or ceilings or both.

Although various features of the methods of manufacturing building sections or room units have been described and illustrated in the accompanying drawings, and various features of the sections or units themselves, will be set forth in the following claims as inventive features, it is emphasized that the invention is not necessarily limited to those features and includes within its scope each of the constructional steps described illustrated and each part described or illustrated both individually and in various combinations.

Having thus described my invention, what I claim as new and desire to secure by Letters Patent of the United States is:

1. A method for the manufacture of prefabricated building sections at a factory prior to transporting same to the site which comprises making a panel and subsequently connecting at least one vertically disposed metal frame beam having a hollow core to that panel, wherein making the panel comprises the steps of forming a frame of metal beam members, arranging a first plate on said frame, arranging a second plate which is spaced vertically from said first plate on said frame and providing the panel with at least one tubular service conduit, providing an opening completely through said panel which is at least in part extending through and defined by both said frame and said plates, the completed panel thereafter being rigidly connected to said frame beam by welding said beam members to said frame beams whereby the lower part of said frame beam is received through said opening for the entire vertical height of said panel.

2. A method as claimed in claim 1, wherein at least one tubular conduit is arranged internally of at least one of said plates.

3. A method as claimed in claim 2, wherein said tubular conduit is arranged internally of at least one of said plates during the manufacture of that plate.

4. A method as claimed in claim 3, wherein said tubular conduit is arranged between said first and second plates.

5. A method as claimed in claim 1, wherein said frame beam connected to the completed panel is of tubular formation.

6. A method as claimed in claim 5, wherein the panel frame is of rectangular configuration, and wherein said frame beam that is connected to the panel after the completion thereof is located proximate one corner of the panel frame, and wherein said first and second plates are located internally of the rectangular periphery of the panel frame.

7. A method as claimed in claim 6, wherein said rectangular frame is of oblong configuration, and wherein at least one further frame beam is secured to the completed panel frame at a location along one of the longer sides of said oblong between two adjacent corners of said frame.

8. A method as claimed in claim 1, wherein two said vertically disposed frame beams are connected to said panel and at least one wall partition is arranged between said two frame beams after they have been connected to said panel.

9. A method as claimed in claim 1, wherein said opening is defined by at least one of said plates and by part of at least one of the beam members of the panel frame.

10. A method as claimed in claim 1, wherein said frame beam connected to the completed panel comprises a central core provided with a surrounding sheath-like layer.

11. A method as claimed in claim 1, wherein said panel is constructed with sufficient strength to serve as a floor panel.

12. A method as claimed in claim 1, wherein said frame beam that is connected to the panel subsequent to the completion thereof serves as a supporting column of the building section and also as a supporting column of a building of which the completed section forms a part.

13. A method for the manufacture of a prefabricated panel for use in building comprising the steps of forming a frame by connecting at least two beam members, arranging a first plate on said frame by placing said frame in a jig with said beam members provided to surround the sides thereof and casting said first plate while in said jig surrounded by said beam members of said frame, arranging a second plate on said frame in a vertically parallel spaced relationship with said first plate, providing at least one tubular service conduit internally of at least one of said plates, forming said plates to define at least in part superimposed substantially identical openings adjacent one of said beam members and providing that said one beam member defines at least part of at least one of said openings, said plates being made from castable material which is cast contacting said one beam member, inserting a vertically disposed frame beam completely through both said openings defined by said plates and said one beam member, and rigidly securing said vertical frame beam to said one beam member.

14. A method as claimed in claim 13, wherein at least one tubular conduit is prearranged in said jig to enable the castable material of said first plate to harden around said conduit.

15. A method of manufacturing a prefabricated building section which includes horizontal and vertical beam members, the method comprising the steps of:

forming a frame of horizontal beam members in a rectangular configuration, each said beam member comprising a vertical limb and a pair of horizontal limbs rigidly joining said vertical limb and being spaced vertically apart, said horizontal limbs being disposed so as to extend inwardly relatively to said frame;

casting a first horizontal plate of cementitious material on said frame whereby it contacts an upper set of said limbs, casting a second horizontal plate of cementitious material spaced vertically from said first plate on said frame whereby it contacts a lower set of said limbs;

defining in the casting of said first and second plates vertically superimposed similarly shaped openings in said first and second plates which are both adapted to receive the same vertically disposed frame beam member whereby said vertical frame beam member extends through both said plates; and disposing said vertical frame beam member whereby it is received by both said openings and rigidly connecting said vertical frame beam member to said first and second plates.

16. A method in accordance with claim 15, wherein said connection of said vertical frame beam member to said plates is effected in part by inserting a hardenable material between the edges of said plates defining said openings and said vertical frame beam member while it is disposed in said openings whereby said vertical frame beam member is rigidly connected to said plates when said material hardens.

17. A method in accordance with claim 16, wherein said openings are defined in part by said upper and lower sets of said limbs, said vertical frame beam member comprising a central metal portion which is rigidly connected to said limbs proximate to where they define at least one said opening prior to the insertion of said hardenable material.

18. A method in accordance with claim 17, wherein an aperture is provided in the upper set of said limbs proximate said upper opening, said hardenable material being inserted at least in part through said aperture.

19. A method for the manufacture of prefabricated building sections comprising making a panel and subsequently connecting at least one vertically disposed frame beam to that panel, wherein making the panel comprises the steps of forming a frame of beam members, arranging a first plate on said frame, arranging a second plate which is spaced vertically from said first plate on said frame and providing the panel with at least one tubular service conduit, providing an opening completely through said panel which is at least in part through said frame, the completed panel subsequently having said frame beam connected thereto by inserting the lower part of said frame beam through said opening for the entire vertical height of said panel, said frame beam comprising a central core and a surrounding sheath-like layer, said core being of metallic construction and the connection of said frame beam to the completed panel frame including the step of welding said metal core to at least one said beam member of said panel frame.

20. A method as claimed in claim 19, wherein said central core is of tubular configuration.

21. A method as claimed in claim 20, wherein said core is secured to said one beam member of the panel frame at locations proximate the opposite outer surfaces of the panel.

22. A method as claimed in claim 21, wherein a portion of said central core that is located internally of the panel after the connection of the corresponding frame beam to that panel is substantially completely surrounded by said sheath-like layer, and wherein the portion of said corresponding beam that projects from the surface of the panel is similarly surrounded throughout its length with said sheath-like layer, said sheath-like layers over said core portions being comprised of fireproof material.

23. A method as claimed in claim 22, wherein the sheath-like layer around the central core is formed from a material that is cast around that core.

24. A method as claimed in claim 23, wherein a jig is formed in an opening of the panel in spaced relationship around said central core of the corresponding frame beam, the material of said sheath-like layer subsequently being cast around said core in said jig.

25. A method as claimed in claim 24, wherein the jig is afforded partly by portions of said beam member of the panel frame and partly by jig plates disposed between the first and second plates of the panel.

26. A method for the manufacture of prefabricated building sections comprising making a panel and subsequently connecting at least one vertically disposed frame beam to that panel, wherein making the panel comprises the steps of forming a frame of beam members, arranging a first plate on said frame,arranging a second plate which is spaced vertically from said first plate on said frame and providing the panel with at least one tubular service conduit, providing an opening completely through said panel which is at least in part through said frame, the completed panel subsequently having said frame beam connected thereto by inserting the lower part of said frame beam through said opening for the entire vertical height of said panel, said first and second plates of said panel being formed principally from cast concrete and being provided in the casting step with edges to define said opening through said panel.

27. A method as claimed in claim 26, wherein said frame beam comprises a central core and a sheath-like layer is cast around said central core of said frame beam.

28. A method for the manufacture of a prefabricated panel for use in building comprising the steps of forming a frame by interconnecting at least two beam members, arranging a first plate on said frame, arranging a second plate on said frame in a vertically parallel spaced relationship with said first plate, providing at least one tubular service conduit internally of at least one of said plates, forming said plates to define at least in part superimposed substantially identical openings adjacent one of said beam members and providing that said one beam member defines at least part of at least one of said openings, inserting a vertically disposed frame beam completely through said openings defined by said plates and said one beam member, and rigidly securing said vertical frame beam to said one beam member, said plates being made from castable material which is cast contacting one said beam member, and panel frame being laid in a jig with said beam members provided to surround the sides thereof, the material of which said first plate is cast in said jig being surrounded by said beam members of said frame, at least one rib and a layer of reenforcing mesh being arranged between said surrounding beam members of said panel frame before the material of said first plate is cast.

29. A method as claimed in claim 28, wherein, after the formation of said first plate, the frame and the first plate are removed from the jig, subsequently inverted and placed in a jig in which the second plate is cast.

30. A method as claimed in claim 29, wherein the inverted panel frame and the first plate are pressed downwardly into semi-liquid material that is to form said second plate and that is prearranged in the last-mentioned jig, said frame being left in that jig until the material of the second plate has hardened.

31. A method of manufacturing a prefabricated building section which comprises the steps of:

manufacturing a floor panel which is rectangular, surrounded by a metal frame, has at least one horizontal plate member carried by said frame and an opening in one corner of said plate member proximate a corner of said metal frame;

providing a vertical metal frame beam and sheathing said frame beam with a fireproof material except for a lower portion thereof;

inserting said lower portion of said metal frame beam in said opening and rigidly securing said portion in said opening to said frame;

attaching a jig member to said frame at its corner proximate said opening whereby the jig member surrounds part of said lower portion of said metal frame beam and said frame proximate said opening surrounds the other part of said lower portion of said metal frame beam;

introducing a castable fireproof material between said jig member and said lower portion of said metal frame beam and between said frame proximate said opening and said lower portion of said metal frame beam proximate said opening and allowing said material to set so that said lower portion of said metal frame beam is sheathed in fireproof material.

32. A method of manufacturing prefabricated building sections which comprises the steps of:

making a panel with a hollow interior by forming a frame of metal channel beams with their vertically spaced horizontal limbs all extending inwardly, casting a first plate of concrete material which extends between and under the upper of said limbs and substantially covers the interior vertical portions of said channel beams, casting a second plate of concrete material which extends between and over the lower of said limbs and joins the portion of the first plate's casting covering the interior vertical portions of the channel beams whereby said first and second plates substantially cover the entire interior surface area of said channel beams, and providing in said casting steps a pair of similar openings, one of said openings in each said plates, which are in vertical register;

placing a metal vertical frame beam in said openings and casting a hardenable material around said frame beam where it is received in said panel whereby a layer of concrete material is disposed substantially entirely between said frame and said frame beam on one hand and the hollow interior of said panel on the other.

33. A method in accordance with claim 32, wherein a layer of fireproofing material is provided to surround said frame beam entirely except where it is received in said opening prior to its being disposed in said opening.

34. A method of manufacturing a prefabricated building section which comprises the steps of:

manufacturing a floor panel which is rectangular, surrounded by a metal frame, has at least one horizontal plate member carried by said frame, and an opening along at least side one of said plate member proximate a side of said metal frame;

providing a vertical metal frame beam and sheathing said frame beam with a fireproof material except for a lower portion thereof;

inserting said lower portion of said metal frame beam in said opening and rigidly securing said portion in said opening to said frame;

attaching a jig member to said frame at its corner proximate said opening whereby the jig member surrounds part of said lower portion of said metal frame beam and said frame proximate said opening surrounds the other part of said lower portion of said metal frame beam;

introducing a castable fireproof material between said jig member and said lower portion of said metal frame beam and between said frame proximate said opening and said lower portion of said metal frame beam proximate said opening and allowing said material to set so that said lower portion of said metal frame beam is sheathed in fireproof material.

35. A method in accordance with claim 34, wherein an aperture is provided in said frame proximate said opening and a portion of said castable fireproof material is introduced through said aperture.

* * * * *